US008984678B2

(12) United States Patent
Brunelle et al.

(10) Patent No.: US 8,984,678 B2
(45) Date of Patent: Mar. 24, 2015

(54) AIR INJECTION SYSTEM FOR A HYDRO-MASSAGING BATH

(75) Inventors: Henry Brunelle, Québec (CA); Louis Gendreau, Sainte-Marie (CA); Danny Grenier, Québec (CA); Guy Baillargeon, St-Etienne de Lauzon (CA)

(73) Assignee: Geston Ultra International Inc., St-Nicolas, QC ( * ) Notice: Subject to any disclaimer, the term of this patent is extended or adjusted under 35 U.S.C. 154(b) by 685 days.

(21) Appl. No.: 13/173,009

(22) Filed: Jun. 30, 2011

(65) Prior Publication Data

US 2013/0000031 A1 Jan. 3, 2013

(51) Int. Cl.
*A61H 33/02* (2006.01)
*A61H 33/00* (2006.01)

(52) U.S. Cl.
CPC ..... *A61H 33/02* (2013.01); *A61H 33/026* (2013.01); *A61H 33/6063* (2013.01); *A61H 33/028* (2013.01); *A61H 2033/002* (2013.01); *A61H 2033/0037* (2013.01); *A61H 2201/0228* (2013.01); *A61H 2201/50* (2013.01)
USPC ..... 4/541.4; 4/541.1; 4/541.3; 4/541.5

(58) Field of Classification Search
USPC ..... 4/541.1, 541.3, 541.4, 541.5
See application file for complete search history.

(56) References Cited

U.S. PATENT DOCUMENTS

| | | | | |
|---|---|---|---|---|
| 6,009,574 | A * | 1/2000 | Moreland | 4/541.5 |
| 6,317,903 | B1 * | 11/2001 | Brunelle et al. | 4/541.4 |
| 2007/0192952 | A1 * | 8/2007 | Lau | 4/541.1 |
| 2008/0172783 | A1 * | 7/2008 | Smith et al. | 4/541.4 |
| 2010/0223721 | A1 * | 9/2010 | May et al. | 4/541.1 |

FOREIGN PATENT DOCUMENTS

| | | | |
|---|---|---|---|
| GB | 2 224 203 | | 5/1990 |
| GB | 2224203 | A * | 5/1990 |

* cited by examiner

*Primary Examiner* — Greg Huson
*Assistant Examiner* — Lauren Crane
(74) *Attorney, Agent, or Firm* — Norton Rose Fulbright Canada LLP; Alexandre Daoust

(57) ABSTRACT

An air injection system for a hydro-massaging bath is described. An air convecting conduit is in communication with a plurality of injecting orifices formed in a peripheral wall of the bath. An air blower injects air under pressure in an entry opening of the air convecting conduit. A water spray injector is located downstream of the entry opening and upstream of the air injecting orifices to inject a spray of a predetermined volume of water in the injected air under pressure. A water supply conduit is connected to the water spray injector and has a flow regulating valve to regulate the volume of water spray injected in the heated air to saturate the air with water. A shut-off valve is provided in the water supply conduit, and a heater is disposed in the air convecting conduit downstream of the water spray injector and upstream of the air injecting orifices wherein heated, humidified air injected in the water contained within the bathtub does not produce a cool sensation on the body of a user person.

12 Claims, 3 Drawing Sheets

AIR INJECTION SYSTEM FOR A HYDRO-MASSAGING BATH

TECHNICAL FIELD

The present invention relates to an air injection system for a hydro-massaging bath to eliminate the effect of coolness on the body of a user person immersed in hot water within the bath and in close proximity to air injecting orifices.

BACKGROUND ART

It is well known to inject air in the hot water contained in a bathtub to provide a turbulence of the water whereby a user person receives a massaging therapy by the turbulent water. A plurality of orifices are distributed in the side walls of the bathtub in areas where a water massage is required such as in the back wall and lower side wall areas of the bathtub. Various hydro massaging baths are known and such comprise adjustable nozzle assemblies mounted on the wall of a bathtub to discharge high velocity jets of water to impinge upon the body of a user person. However, when injecting air within the hot water, the user person is subjected to a sensation of coolness where the air jets impact its wet body. This sensation is the result of an adiabatic reaction which is caused by air which is relatively dry, and which enters in contact with the water. This sensation is felt even if the air is heated to about 60° C. Increasing the temperature of the air is not the solution to resolve the problem as this would burn a user person's skin. Accordingly, the prior art has opted to mix the air with recirculated water from the bathtub or with heated water such that the injectors comprise a large quantity of water mixed with air.

Another problem of injecting air in the water to cause turbulence is that the air cools the water in the bathtub prematurely because of the large surface contact area of turbulent water with the air. It is therefore desirable to eliminate this cool sensation when injecting air in a bathtub through air injecting orifices or air injectors.

In British Patent GB 2 224 203 published on May 2, 1990, there is disclosed a spa bath in which an air/water mixture is injected via injectors into the water contained within the bath. In that patent, water is taken from the bottom of the bath, heated in a heater and the heated water is supplied to jets within a manifold through which compressed air is blown. The water is injected through venturi orifices which cause water to be sucked through the jets to form fine droplets which are then discharged through the injectors. The droplets of heated water humidify and heat the air immediately before the air/water mixture is injected into the bath, therefore reducing discomfort to the user and maintaining the water temperature in the bath at a desired level. There are several disadvantages of this method, one being that the injector assembly is very expensive and troublesome. In a system as described, it is likely that the injectors will not all operate in a uniform fashion due to variation in pressure along the injector line. The clogging of the venturi gaps due to the fact that the recirculating water entering the nozzles may clog up the nozzles due to the various products and impurities in the water, particularly when water is extracted from the bottom end of the bathtub. Such decalibrates the operation of the injectors. However, this reference confirms that hot bath water is subjected to accelerated cooling when the water is agitated in contact with ambient atmosphere and that unless water is heated to about 50° C., injected air entering the bath will feel cool to a user person's body close to the nozzle creating a "chill effect" caused by blown air in contact with wet skin.

SUMMARY OF INVENTION

It is a feature of the present invention to provide an air injection system for a hydro-massaging bath which substantially overcomes the above-mentioned disadvantages of the prior art.

Another feature of the present invention is to provide an air injection system for a hydro-massaging bath having air injecting orifices to which is fed hot humid air under pressure such that when the hot humid air is injected in the bathtub the cool sensation against a user person's body is eliminated or substantially reduced.

Another feature of the present invention is to provide an air injection system for a hydro-massaging bath wherein hot humid air is injected into the bathtub through an air distribution conduit in which is injected a waterspray to humidify air under pressure and wherein a heater is provided in the conduit to heat the hot humid air to a desired temperature for injection through air injecting orifices formed in the peripheral side walls of the bath.

Another feature of the present invention is to provide an air injection system for a hydro-massaging bath wherein water injected within the pressurized air in the air convecting conduit is regulated by a pressure reducing valve containing a removable filtered cartridge to remove impurities from the spray of water injected in the air to prevent clogging of the injection orifices.

Another feature of the present invention is to control the temperature of hot humid air injected in a hydro-massaging bath whereby to create a heat sensation in the area of the air jets provided in the peripheral side walls of the bath.

According to the above features, from a broad aspect, the present invention provides an air injection system for a hydro-massaging bath. The bath has a bottom wall and peripheral side walls. A plurality of air injecting orifices are distributed in at least some of the peripheral side walls. An air convecting conduit is in communication with the air injecting orifices. An air blower is provided for injecting air under pressure and in an entry opening of the air convecting conduit. A water spray injector is provided in the air convecting conduit downstream of the entry opening and upstream of the air injecting orifices to inject a spray of a predetermined volume of water in the injected air. A water supply conduit is connected to the water spray injector and has a flow regulating valve to regulate the volume of water spray injected in the heated air to saturate the air with water. A shut-off valve is provided in the water supply conduit. A heater is provided in the air convecting conduit downstream of the water spray injector and upstream of the air injecting orifices.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
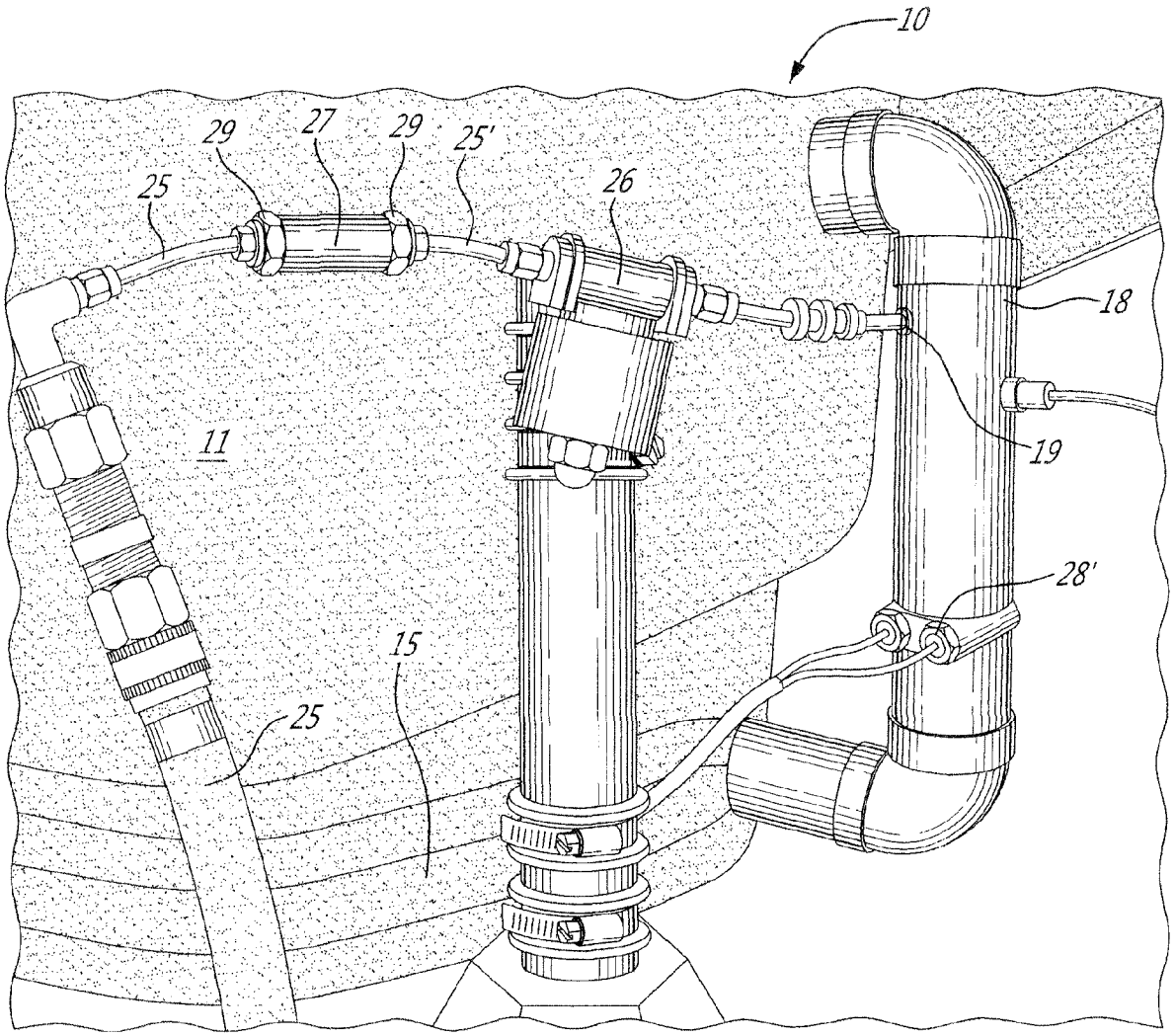
FIG. 1 is a fragmented perspective view illustrating the construction of an air injection system coupled to a side wall of a bathtub and in communication with an air convecting conduit molded within the side wall.
Figure 2:
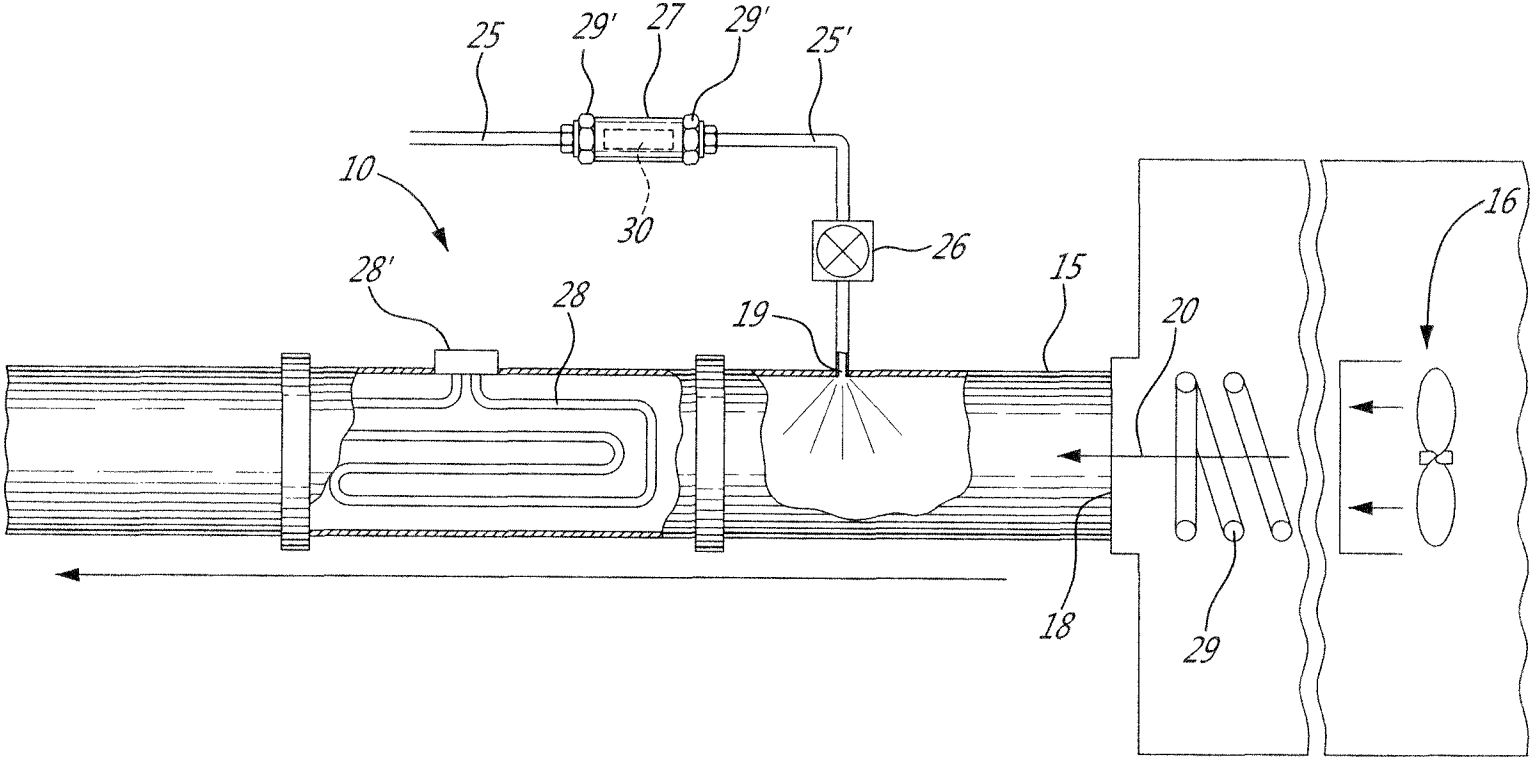
FIG. 2 is a schematic illustration of the air injection system of the present invention.
Figure 3:
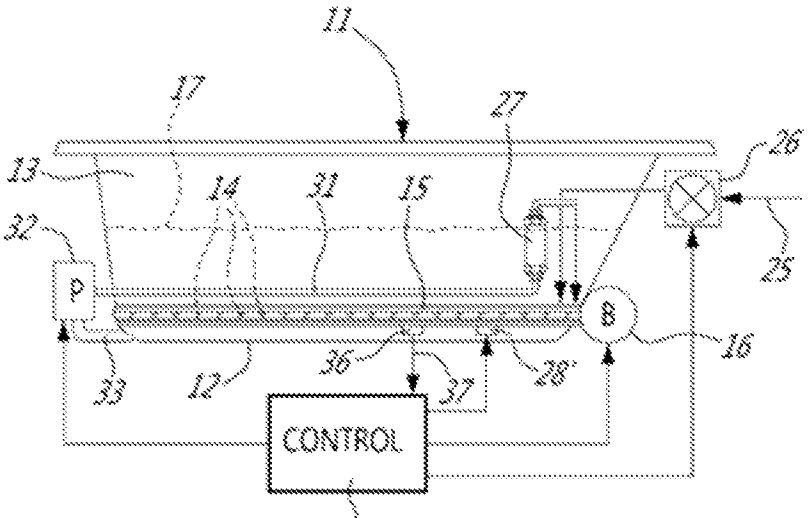
FIG. 3 is a simplified schematic side view showing modifications to the air injection system of the present invention as coupled to a hydro-massaging bathtub.

Referring to the drawings and more particularly to FIGS. 1 to 3, there is shown generally at 10 an air injection system for a hydro-massaging bath 11 constructed in accordance with the present invention. A hydro-massaging bath also includes indoor and outdoor spas having a hybrid system. The bath 11 has a bottom wall 12 and peripheral side walls 13. A plurality of air injecting orifices 14 are provided and distributed at least along some of the peripheral side walls 13. An air convecting conduit 15 surrounds the air injecting orifices 14. Accordingly, when air under pressure by a blower 16 is injected within the air convecting conduit 15 air will enter under pressure into the hot water 17 contained within the bathtub and create a turbulence in the water.

As more clearly shown in FIG. 2, the blower 16 injects air under pressure in an entry opening 18 of the air convecting conduit 15 and a water spray injector 19 spaced from the entry opening 18 injects a spray of water within the pressurized air flow 20. The spray injector 19 is positioned downstream of the entry opening 18 and upstream of the air injecting orifices 14.

The water spray injector 19 is provided water from the domestic water line 25. i.e., a water supply line generally provided in homes and/or households, via a flow regulating valve 27 and a solenoid valve 26 whereby to regulate the pressure and/or volume of water sprayed into the air flow 20 to assure that the air is fully saturated with humidity.

As also shown in FIG. 2, a resistive heating element 28 is mounted within the air convecting conduit 15 downstream of the water spray injector 19 and upstream of the air injecting orifices 14 whereby to quickly heat and vaporize the saturated air to a desired temperature. As shown in FIG. 2, a heating coil 29 or a further resistive heating element (not shown) may be interposed in the air flow path 20 between the blower and the entrance opening to pre-heat the injected air within the air convecting conduit 15.

In FIGS. 1 and 2, it can be seen that the flow regulating valve 27 is disconnectably secured in the water supply conduit 25 by lock nuts 29' to give access to a filter cartridge 30 housed within the flow regulating valve 27. The cartridge 30 filters impurities from the water supply line 25. This is particularly useful, as shown in FIG. 3, when the water supply line is a recirculating conduit 31 which recirculates the water 17 from the bath 11 through a pump 32. The pump 32 draws the water from the bottom of the bath 11 through a conduit 33 and feeds it to the flow regulating valve 27. In such an arrangement the solenoid valve 26 would not be necessary as the controller 35 would control the operation of the pump 32 to stop the flow of recirculating water.

As also shown in FIG. 3, the controller 35 controls the blower 16, the electrical supply terminal 28' of the resistive heating element 28 and the solenoid valve 26 when a recirculating conduit 31 is not provided.

In order to completely saturate the air flow 20 it has been found that the flow regulating valve needs to be adjusted to inject between 4 gallons per hour (GPH) to 15 GPH of water into the air flow 20. By controlling the adjustment of the solenoid valve 26 the volume of water injected in the air flow can be controlled. The water spray injector 19 is herein constituted by a small air injecting orifice formed in a side wall of the air convecting conduit 15 and has an orifice size of about 2 mm. The controller 35 also controls the blower speed 16 to control the air flow displacement and therefore pressure of air injected in the bath through the air injecting orifices. Accordingly, the control circuit 35 can regulate the temperature and pressure of hot saturated air injected in the water 17 contained within the bath 11.

A thermostat 36 is conveniently secured to the air convecting conduit 15 to feed temperature signals to the control device 35 via its connection 37 whereby the control device 35 can automatically make the necessary adjustments to regulate the temperature and saturation of the air under pressure in the air convecting conduit 15. The temperature of the heated saturated air, when injected into the water within the bath, is in the range of about 34° C. to 45° C. and at such temperature there is no harm to the skin of a user person bathing in the bath while the "chill effect" sensation is substantially eliminated. In fact, when the temperature is in the higher range, a sensation of warmer water is felt on a user skin without fear of burning the skin of the user person.

Figure 4B:
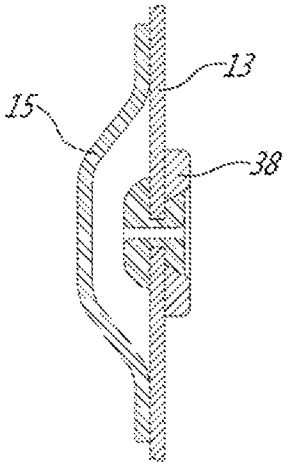
FIG. 4B is a view similar to FIG. 4A but showing a further embodiment wherein the air injecting orifices are provided with adjustable injection nozzles.
Figure 4A:
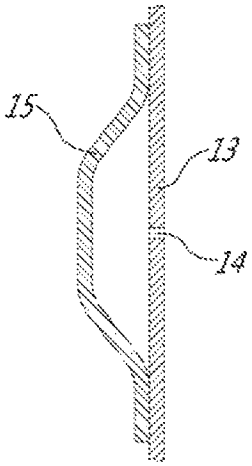
FIG. 4A is a fragmented section view showing one embodiment of the air injecting orifices distributed in the peripheral side walls of the bathtub.

Referring to FIGS. 4A and 4B, there are shown two versions of the air injecting orifices 14. As shown in FIG. 4A, the air injecting orifice 14 is simply a hole formed in the peripheral wall 13 of the bathtub and in communication with the air convecting conduit 15. The size and dimension of this hole is described in previous patents of Bain Ultra and does not form part of the present invention. Also, as shown in FIG. 4B, the air injecting orifices may be constituted by adjustable injection nozzles 38 disposed in communication with the air convecting conduit 15. The bath 11 may be a therapeutic bathtub incorporating various therapeutic treatments such as lumino therapy, hydro therapy and thermal therapy. Another advantage of the air injection system of the present invention is that the water within the bathtub can stay hot longer and the water is cleaner and sterilized by the use of removable filter cartridges provided in the flow regulating valve such cartridges being accessible for replacement.

Another advantage of the present invention is that after use, the controller can automatically engage a cleaning and drying cycle wherein the solenoid valve 26 is shut-off and the air blower is engaged whereby to flush out any residual humidity within the air convecting conduit 15 and the injectors to dry out the air convecting conduit and injector orifices. The heater 28 may also be actuated to accelerate the drying cycle if the resistive heating elements 29 within the blower are not sufficient.

It is within the ambit of the present invention to cover any obvious modification of a preferred embodiment described herein provided such modifications fall within this scope of the appended claims.

We claim:

1. An air injection system for a hydro-massaging bath, said bath having a bottom wall and peripheral side walls, a plurality of air injecting orifices distributed at least along some of said peripheral side walls, an air convecting conduit in communication with air injecting orifices, an air blower for injecting air under pressure in an entry opening of said air convecting conduit, a water spray injector in said air convecting conduit downstream of said entry opening and upstream of said air injecting orifices to inject a spray of a predetermined volume of water in said injected air, a water supply conduit connected to said water spray injector and having a flow regulating valve to regulate the volume of water spray injected in said air to saturate the air with water, a shut-off valve in said water supply conduit, and a heater in said air convecting conduit, downstream of said water spray injector and upstream of said air injecting orifices.

2. An air injection system as claimed in claim 1 wherein said flow regulating valve is disconnectably secured in said water supply conduit.

3. An air injection system as claimed in claim 2 wherein said flow regulating valve has a filter cartridge removably retained therein, said water supply conduit being a water recirculating conduit having a pump to recirculate water from within said bath.

4. An air injection system as claimed in claim 2 wherein said water supply conduit is connected to a domestic water supply.

5. An air injection system as claimed in claim 1 wherein said air blower is provided with a heating element to preheat air injecting in said entry opening.

6. An air injection system as claimed in claim 1 wherein said predetermined volume of water is between 4 GPH to 15 GPH suitable to completely saturate said air injected by said blower.

7. An air injection system as claimed in claim 1 wherein said air blower is a variable speed blower, and control means to regulate the speed of said blower to thereby regulate the pressure in said air convecting conduit.

8. An air injection system as claimed in claim 1 wherein said water spray injector is constituted by a small air injecting orifice formed in a sidewall of said air convecting conduit and in communication with said water supply conduit, said small air injecting orifice having an orifice size of about 2 mm.

9. An air injection system as claimed in claim 1 wherein the shut-off valve is a solenoid valve connected in said water supply conduit downstream of said flow regulating valve.

10. An air injection system as claimed in claim 7 wherein said control means is a control device to further regulate the temperature and pressure of hot saturated air injected in water contained in said bath, a thermostat in communication with said air convecting conduit to feed temperature signals to said control device; said control device controlling at least one of said heater and said variable speed blower to regulate the temperature of said heated saturated air injected into said water in the range of about 34° C. to 45° C.

11. An air injection system as claimed in claim 1 wherein said air injecting orifices are formed by holes in direct communication with said air convecting conduit.

12. An air injection system as claimed in claim 1 wherein said heater is a resistive heating element disposed in a section of said air convecting conduit to quickly heat and vaporize said saturated air.

* * * * *